US005548925A

United States Patent [19]

Marocco

[11] Patent Number: 5,548,925

[45] Date of Patent: Aug. 27, 1996

[54] TOGGLE CONNECTOR FOR SHUTTER CONTROL BAR

[76] Inventor: Norbert Marocco, 46 Pennycross Ct., Woodbridge, Ontario, Canada, M4L 3M6

[21] Appl. No.: 490,299

[22] Filed: Jun. 14, 1995

[51] Int. Cl.[6] ..... E06B 7/086

[52] U.S. Cl. ..... 49/74.1; 49/87.1; 49/92.1

[58] Field of Search ..... 49/74.1, 92.1, 49/87.1, 371; 403/348; 411/553, 549; 454/221, 224

[56] References Cited

U.S. PATENT DOCUMENTS 395,902 1/1889 Heidt .
456,306 7/1891 Heidt .
1,340,252 5/1920 Rasmussen .
4,655,003 4/1987 Henley .
5,187,896 2/1993 Ross .
5,303,507 9/1995 Oille ..... 49/74.1

*Primary Examiner*—Kenneth J. Dorner
*Assistant Examiner*—Curtis A. Cohen

[57] ABSTRACT

A pull bar connector for a shutter bar of a shutter having blades with a hollow interior and a pull bar, and having, a body, a locking device interengagable with the pull bar, to secure the body to the pull bar, the body having a free end, a first integral toggle rigidly extending on one side of the body and, a second toggle rigidly extending on a second side of the body aligned on common axis with the first toggle, for insertion into and rotation within the hollow interior of a blade.

8 Claims, 3 Drawing Sheets

16
42
24a
38a
36a 24
14
22
24
40
18
20
22
42
24

TOGGLE CONNECTOR FOR SHUTTER CONTROL BAR

FIELD OF THE INVENTION

The invention relates to control bars for shutters of the type having horizontal shutter blades mounted in a frame and operated by a single control bar attached to the exterior to the shutter blades.

BACKGROUND OF THE INVENTION

Shutters with horizontal blades have been known for probably hundreds of years. Usually the blades are coupled to a pull bar or control bar so that the blades can be swung upwardly and downwardly between open and closed positions. In the past, when the blades were made of wood, simple wood fastenings such as screw eyelets could be secured in the edges of the blades and wire hooks could be secured in the pull bar which was also made of wood.

Many variations on this basic system are shown in earlier Patents.

More modern shutters of this type are made with blades of extruded plastic material. The material is hollow so that it presents a hollow aerofoil shape, and such shutter blades have a pleasing appearance. It is also desirable that the pull bar shall also be made of hollow plastic and that the attachments between the pull bar and blades shall also be made of plastic so that the entire shutter can be formed of plastic material giving it an extended working life without maintenance, and also reducing the cost.

The attachment of the pull bars to the blades requires that, at the point of attachment to each blade, the attachment device is secure and the blades shall be capable of rotational movement relative to the pull bar, in order to permit the blades to swing between open and closed positions.

BRIEF SUMMARY OF THE INVENTION

With a view to providing a pull bar connector for a shutter pull bar, for use in association with a shutter having blades, and a hollow pull bar, connectable to said blades, the invention provides a toggle connector having a connector body portion, a locking portion interengagable with said pull bar, whereby to secure said body portion to said pull bar in substantially normal relation, a free end on said body portion, a first integral toggle portion on one side of said body portion, and, a second integral toggle portion on a second side of said body portion aligned on common axis with said first toggle portion, for insertion into and rotation within the hollow interior of a said blade.

A further feature of the invention provides a flange base on said body portion surrounding said locking portion, and adapted to abut against a portion of said pull bar, when the same are interengaged with one another.

A further feature of the invention is the provision of a slotted recess in the edge each said blade, said slotted recess having a predetermined width W and predetermined length L, and wherein said length L is substantially equal to the distance between the free end of said first toggle portion and free end of said second toggle portion, whereby said second toggle portion may be inserted said slotted recess and whereby said first toggle portion may then be rotated within the interior of said blade, and is thereby captively retained within said blade.

A further feature of the invention is the provision of a body portion having a continuously tapering profile, reducing from said end adjacent said pull bar, to said free end, said free end at least being adapted to fit within said slotted opening in said blade.

A further feature of the invention is the provision of one toggle portion which is shorter than the other, to facilitate rotation of the toggle portions within the hollow blade.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
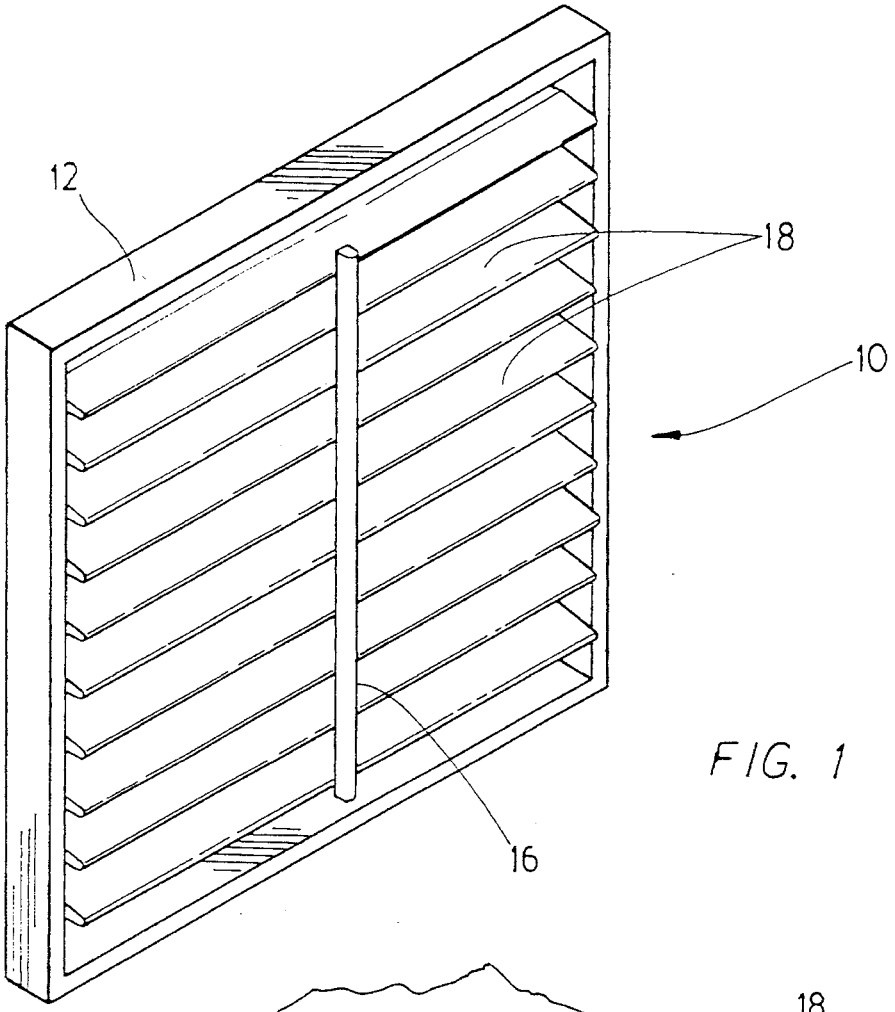
FIG. 1 is a perspective illustration of typical shutter having the plurality of horizontal blades and a single pull bar for controlling them.

Referring to FIG. 1, the shutter 10 is shown there having a frame 12 and generally horizontal blades 14. A vertical pull bar 16 is shown connected to the blades 14. Operation of the pull bar 16 up and down will swing all of the blades between open and closed position.

Figure 2:
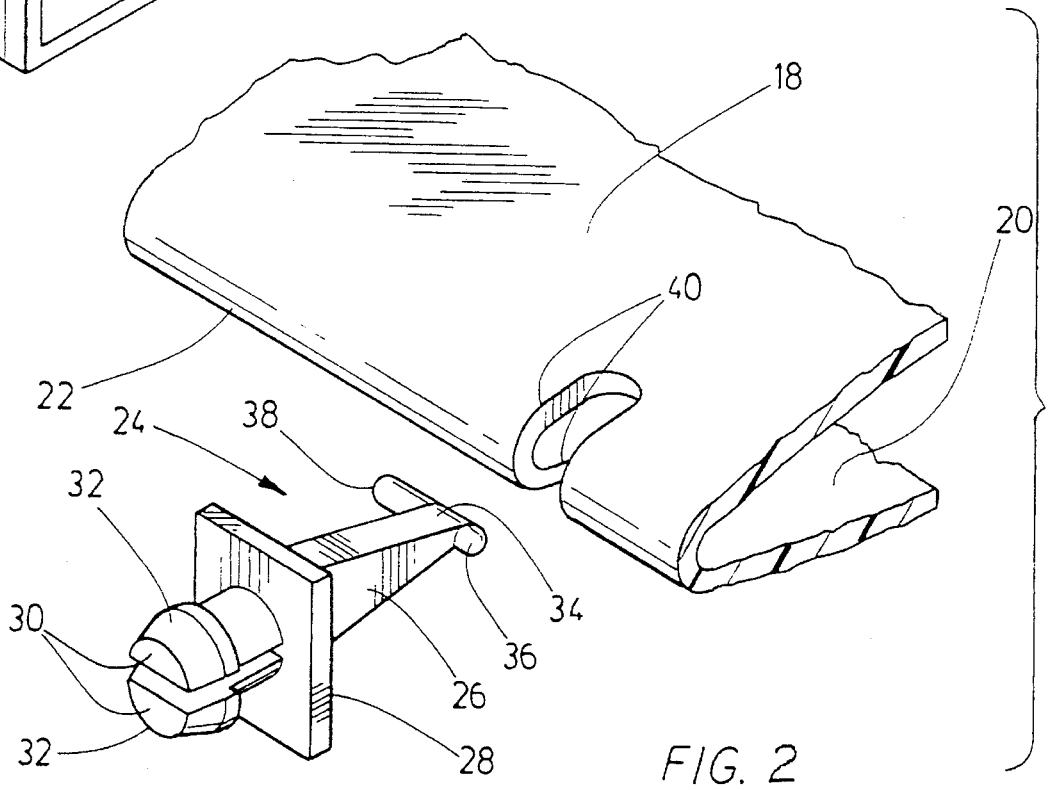
FIG. 2 is an enlarged perspective exploded view of a single connector and a portion of a blade.
Figures 2A, 3:
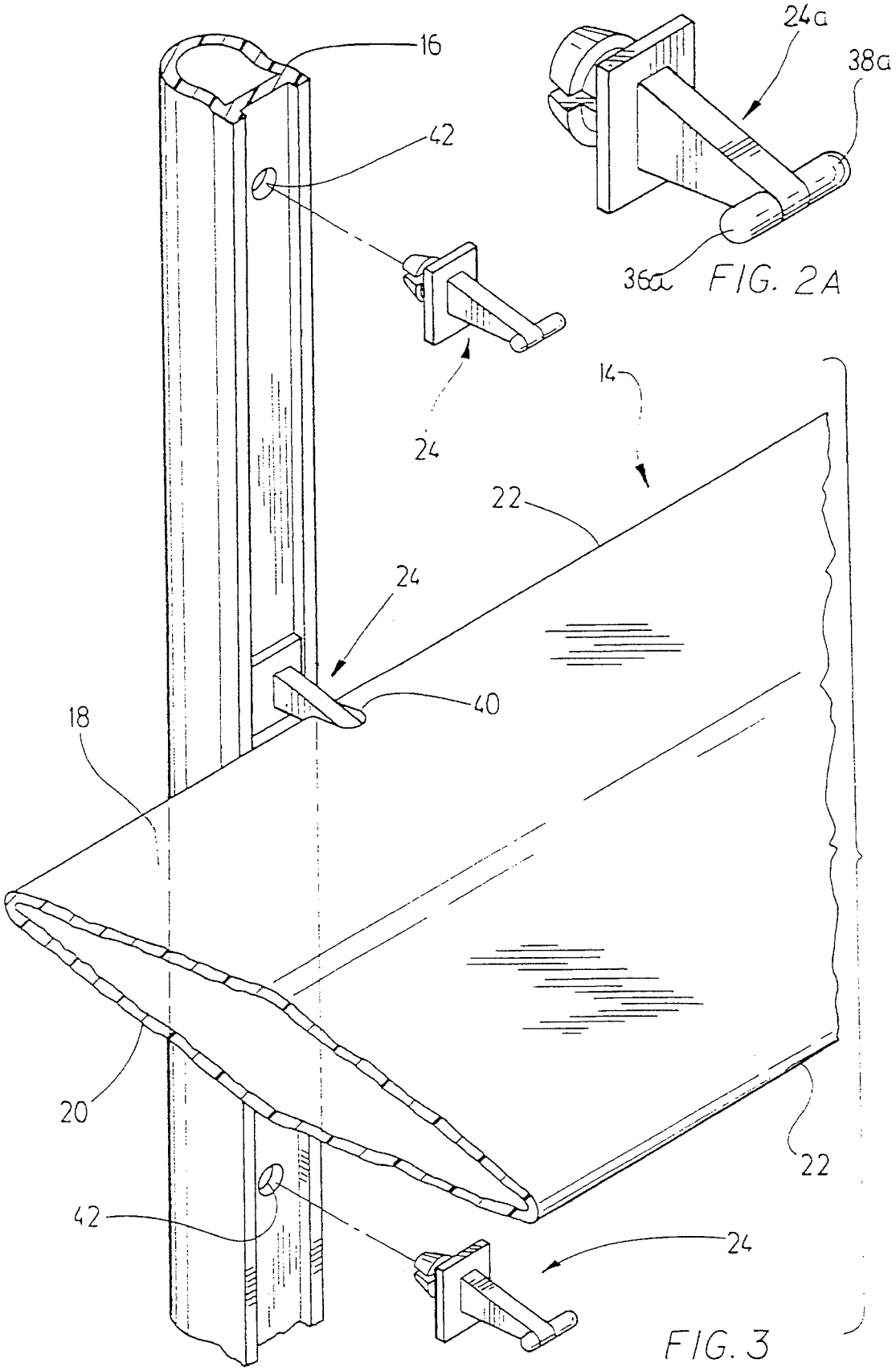
FIG. 2A is a perspective of an alternate form of toggle connector.
FIG. 3 is an enlarged perspective partially exploded view of a single blade and pull bar and connectors.
Figure 4:
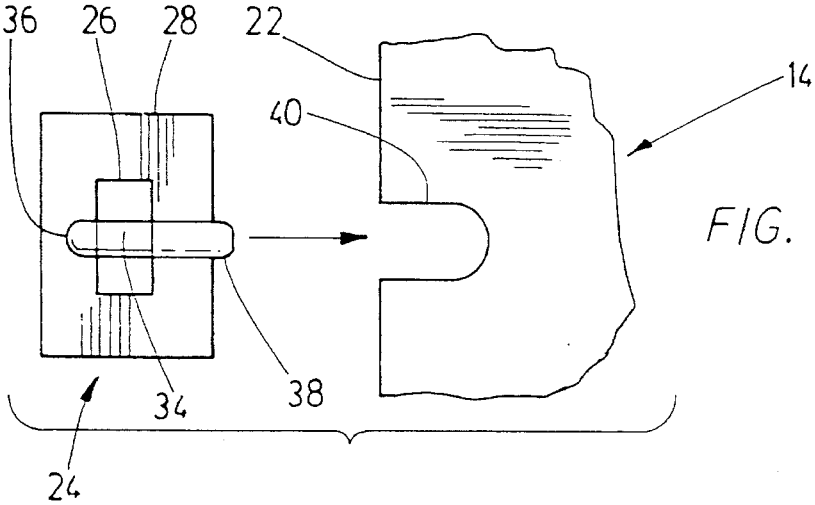
FIG. 4 is a exploded elevational view, showing the first step in the insertion of the connector in the blade.

Referring now to FIGS. 2 and 3, it will be seen that each of the blades 14 consists of a hollow aerofoil shape, having upper and underwalls 18 and 20 meeting at tapering edges 22, and defining a generally aerofoil shape in section. Typically such blades 14 will be formed of extruded thermoplastic material, in a well known manner but other materials, and manufacturing methods may be suitable in some cases.

As shown in FIG. 2, the pull bar 16 is shown connected to the blades by a series of blade connectors 24, two of which are shown in exploded form. A third blade connector 24 is shown actually connected directly between the pull bar 16 and the blade edge 22 of blade 14 and is only partly visible.

Referring to FIG. 3, the blade connector 24 will be seen to comprise a connector body portion 26, having a generally tapering body shape along its length, and having at its larger end, a generally rectangular base flange 28. A pair of locking fingers 30—30 are formed integrally with the base 28. Each of the locking fingers 30 are formed of generally semicylindrical shape in section, and are spaced apart from one another and are flexible towards and away from one another. Locking abutments 32 are formed on the free ends of the fingers 30 for interlocking with the interior of the pull rod 16.

The connector body 26 tapers to a reduced size free end 34, remote from flange 28. On the one side of end 34 is a first integral toggle portion 36 of a first length. On the opposite side of body end 34 is a second integral toggle portion 38 of a second length. The second toggle portion is longer than the first toggle portion, and they are aligned on a common axis. The two toggle portions are integral with body 26 and are rigidly fixed thereto.

Also shown in FIG. 3, is the formation of the blade walls 18 and 20 being formed with slotted recesses 40—40 registering one another, and opening to the exterior at the blade edge 22.

Another form of toggle connector 24*a* is shown in FIG. 2A. In this case the two toggle portions 36*a* and 38*a* are of equal length. This may require a slight modification to the slot in the blade (not shown).

Finally, referring to FIG. 2, the pull rod 16 is also formed of hollow construction, and is formed with a plurality of spaced apart engagement openings 42 therein.

Figure 5:
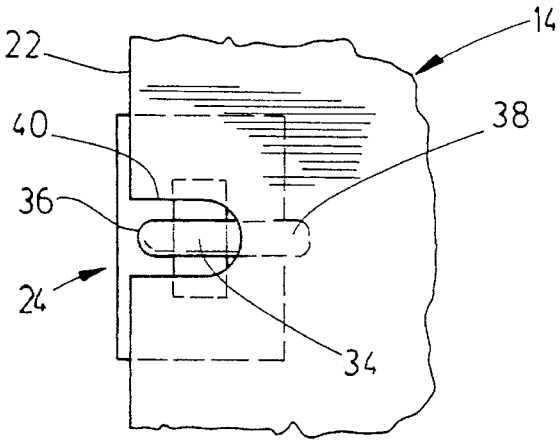
FIG. 5 is a view corresponding to FIG. 4, showing a second step in the insertion of the connector.

As shown in the assembly series of drawings of FIGS. 4, 5, 6, and 7, the first step in the assembly is to assemble one of the connectors 24 with each one of the blades 14. The first step (FIG. 4) is to insert the longer second toggle portion 38 into the slot 40, as far as it will go. This will cause the end 34 of the toggle body 26 to reach the blind end of the recess 40. The shorter toggle portion 36 will then just be in a position where it is at the mouth of the recess 40 as shown in FIG. 5.

Figure 6:
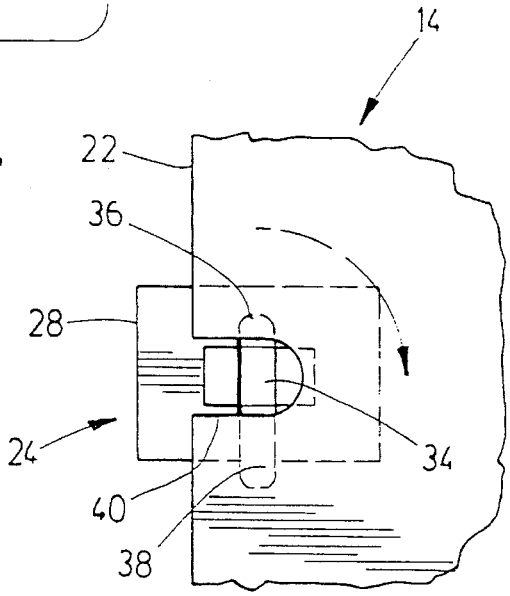
FIG. 6 is a view corresponding to FIG. 5 and showing a third step, and semi-rotation of the connector.

The connector 24 can than be rotated through 90° as shown in FIG. 6. This will cause the shorter first toggle portion 26 to enter into the recess 40, and be positioned between the two blade walls 18 and 20. Similarly, the longer toggle portion 38 will rotate so that the two toggle portions 36 and 38 adopt a position aligned parallel with but spaced from the edge 22 of the blade.

Figure 7:
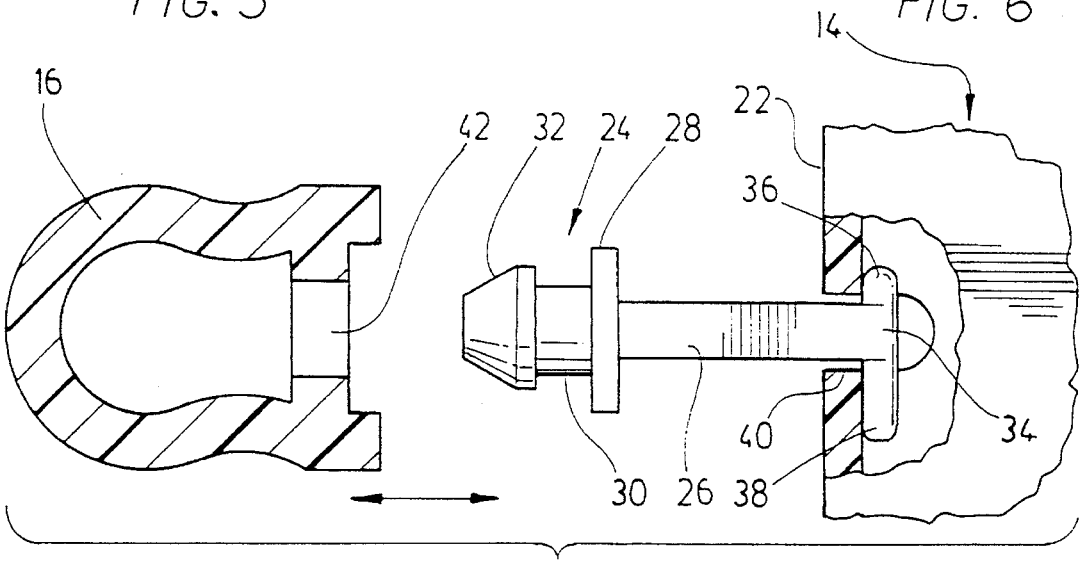
FIG. 7 is a view corresponding to FIG. 6 and showing a fourth step comprising a further semi-rotation of the connector, and showing attachment of the pull bar.

Finally, in FIG. 7, the connector 24 can be withdrawn slightly from the recess 40. The will bring the toggle portions 36 and 38 into engagement with the interior of the edge 22 of the blade. In this position, they are captively engaged within the blade, but will permit relative rotation, so as to permit upward and downward rotational movements of the blades.

Engagement between the connectors 24 and the pull bar 16 is also illustrated in FIG. 7. All that is required is simply to register the fingers 30 with an opening 42 in the pull bar 16 and then to press the two firmly together. This will cause the fingers 30 to squeeze together, and they will then expand outwardly, when they pass into the interior of the pull rod 16, and be captively engaged therein. In this position, the base flange 28 is drawn tightly against the outer surface of the pull bar 16 thereby holding the connectors 24 securely in a position normal to the pull bar 16.

The operation of the invention is self evident from the foregoing description.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A pull bar connector for a shutter bar, for use in association with a shutter having plastic blades having a hollow interior, and a hollow pull bar, for operating said blades, said connector comprising;

a body portion;

a locking portion interengagable with said pull bar, whereby to secure said body portion to said pull bar in substantially normal relation;

a free end on said body portion;

a first integral toggle portion rigidly extending on one side of said body portion, and, a second integral toggle portion rigidly extending on a second side of said body portion aligned on a common axis with said first toggle portion, for insertion into and rotation within the hollow interior of a said blade and wherein said first toggle portion has a first predetermined length, and wherein a said second toggle has a second predetermined length, different from said first length.

2. A pull bar connector as claimed in claim 1 and including a flange base on said body portion surrounding said locking portion, and adapted to abut against a portion of said pull bar, when the same are interengaged with one another.

3. A pull bar connector as claimed in claim 1 and including a slotted recess in the edge of each said blade, said slotted recess having a predetermined width W and a predetermined length L, and wherein said length L is substantially equal to the distance between the free end of said first toggle portion and the free end of said second toggle portion whereby one said toggle portion may be inserted into said slotted recess and whereby the other said toggle portion may then be rotated within the interior of said blade, and is thereby captively retained within said blade.

4. A pull bar connector as claimed in claim 3 and wherein said body portion has a continuously tapering profile, reducing from an end adjacent said pull bar to said free end, said free end at least being adapted to fit within said slotted recess in said blade.

5. A shutter having plastic blades with a hollow interior, and a hollow pull bar for operating said blades, and a plurality of pull bar connectors said connectors comprising;

a body portion;

a locking portion interengagable with said pull bar whereby to secure said body portion to said pull bar in substantially normal relation;

a free end on said body portion;

a first integral toggle portion rigidly extending on one side of said body portion and, a second integral toggle portion rigidly extending on a second side of said body portion aligned on a common axis with said first toggle portion, for insertion into and rotation within the hollow interior of a said blade and wherein one said toggle portion has a first predetermined length, and the other said toggle portion has a second predetermined length, different from said first length.

6. A shutter as claimed in claim 5 and including a flange base on said body portion surrounding said locking portion, and adapted to abut against a portion of said pull bar, when the same are interengaged with one another.

7. A shutter as claimed in claim 5 and including a slotted recess in the edge of each said blade, said slotted recess having a predetermined width W and predetermined length L, and wherein said length L is substantially equal to the distance between the free end of said first toggle portion and free end of said second toggle portion, whereby one said toggle portion may be inserted into a said slotted recess and whereby the other said toggle portion may then be rotated within the interior of said blade, both toggle portions being thereby captively retained within said blade.

8. A shutter as claimed in claim 7, and wherein said body has a continuously tapering profile, reducing from an end adjacent said pull bar, to said free end, said free end at least being adapted to fit within said slotted recess in said blade.

* * * * *